United States Patent [19]

Shea

[11] 4,255,839

[45] Mar. 17, 1981

[54] AUTOMOTIVE CLUTCH ALIGNMENT TOOL

[76] Inventor: Daniel Shea, 55 Pleasant Ave., Walden, N.Y. 12586

[21] Appl. No.: 79,221

[22] Filed: Sep. 26, 1979

[51] Int. Cl.[3] ..... B25B 27/14

[52] U.S. Cl. ..... 29/274

[58] Field of Search ..... 29/274, 271; 33/180 AT

[56] References Cited

U.S. PATENT DOCUMENTS

| | | | |
|---|---|---|---|
| 1,935,678 | 11/1933 | Valpey | 29/274 |
| 2,044,818 | 6/1936 | Spase . | |
| 2,067,442 | 1/1937 | Frisz | 29/274 |
| 2,097,372 | 10/1937 | Ho . | |
| 2,313,105 | 3/1943 | Walls | 29/271 |
| 2,487,504 | 11/1949 | Yelkin . | |

FOREIGN PATENT DOCUMENTS 993404 10/1951 France .

*Primary Examiner*—Robert C. Watson

*Attorney, Agent, or Firm*—Jack D. Slobod

[57] ABSTRACT

An alignment tool in the nature of a dummy drive shaft for coaxially aligning the parts of an automotive clutch includes splined cylindrical and smooth tubular members for respectively engaging the clutch disc and release bearing parts of the clutch which members are selectively axially separable. An elongated rod insertable through the tubular member has a front end threadable into a bore in the rear of the cylindrical member. The rear end of the rod accepts a nut which is engageable against the rear of the tubular member for enabling the members to be selectively axially locked together.

12 Claims, 5 Drawing Figures

AUTOMOTIVE CLUTCH ALIGNMENT TOOL

FIELD OF THE INVENTION

The present invention relates to dummy drive shaft means for aligning the flywheel pilot bearing, clutch disc and pressure plate assembly release bearing of an automotive clutch. In its particular aspects the present invention relates to a dummy drive shaft composed of axially separable parts configured for assembly or disassembly while at least a portion thereof is located within the interior of the clutch.

BACKGROUND OF THE INVENTION

In the servicing and rebuilding of automotive clutches of the disc type, in order to access the interior of the clutch it is necessary to move the transmission axially away from the clutch which withdraws the drive shaft from the clutch. The amount of work required in accomplishing this movement is often directly related to the distance which the transmission must be moved from the clutch in order to provide adequate clearance therebetween for the insertion and withdrawal of a dummy drive shaft to align the parts of the clutch. Particularly when servicing trucks, movement of the transmission will require removal or movement of numerous tanks, accessories and cross-members, which significantly increase the time required to service the clutch. If the amount of required clearance could be minimized, the need to effect the movement or removal of other parts proximate the transmission would be obviated or minimized.

In the prior art, the most common clutch alignment tool in use is a unitary section cut from the front of a discarded drive shaft. This section includes a neck at its front end for locating the pilot bearing of the flywheel, a splined portion behind the neck for engaging the clutch disc or discs and a smooth portion behind the splined portion for locating the release bearing of the pressure plate assembly. After servicing of the clutch is completed sufficient clearance between the clutch and the drive shaft-transmission combination is necessary to withdraw the dummy drive shaft from the clutch.

While various other special clutch alignment tools and gauges have heretofore been proposed, none have been configured to reduce the amount of clearance required between the clutch and transmission drive shaft combination to effect insertion and withdrawal of the tool or gauge.

OBJECTS OF THE INVENTION

It is an object of the present invention to provide an automotive clutch alignment tool having axially separable parts for assembly and disassembly at least in part within the clutch.

It is a further object of the present invention to provide an alignment tool for an automotive clutch which includes a splined section configured to accept a clutch disc from the rear of said section.

It is yet another object of the present invention to provide a clutch alignment tool which is configured for easy withdrawal from the clutch.

SUMMARY OF THE INVENTION

Briefly, the aforementioned and other objects of the present invention are satisfied by providing a clutch alignment tool which includes a first generally cylindrical elongated member having a neck portion at its front for engagement in the flywheel pilot bearing. The first cylindrical member has a splined surface for engaging a clutch disc and is of sufficient length to engage two clutch discs in a double disc clutch. The splined surface extends to the rear of the first cylindrical member in order that the clutch discs may be engaged over the first cylindrical member from the rear.

A second cylindrical member of a length approximately equal to the first member is smooth for engaging the release bearing of the pressure plate assembly. It is configured to be aligned axially behind the first cylindrical member and selectively axially locked to the first member by means controllable at the rear of the second member. In particular, the second cylindrical member is tubular and an elongated rod is provided sized to pass through the center of the second member. The rod has a threaded front end for reception into a threaded axial bore in the rear of the first member. The rear end of the rod is also threaded to receive a nut which may bear against the rear of the second member to effect locking together of the first and second members.

The second member also includes, at its rear, a radial shoulder for enabling prying out the assembled tool from the clutch.

Also provided, are axially mating means at the rear of the first member and the front of the second member to maintain the members in coaxial alignment. These means comprise a rearwardly directed neck on the first member which is received in a counterbore in the second member.

After servicing of the clutch, the assembled tool is pulled from the clutch a sufficient distance to expose just the entire second member. The second member is detached from the first member while the first member is still within the clutch. Thereafter the first member is pulled out. Since the first and second members are separable and of approximately equal length, about one-half of the clearance is required between the clutch and drive shaft-transmission combination than with a unitary alignment tool.

Other objects, features and advantages of the present invention will become apparent upon perusal of the following detailed description of the preferred embodiments thereof when taken in conjunction with the appended drawing wherein:

DETAILED DESCRIPTION OF THE PREFERRED EMBODIMENTS

Figure 1:
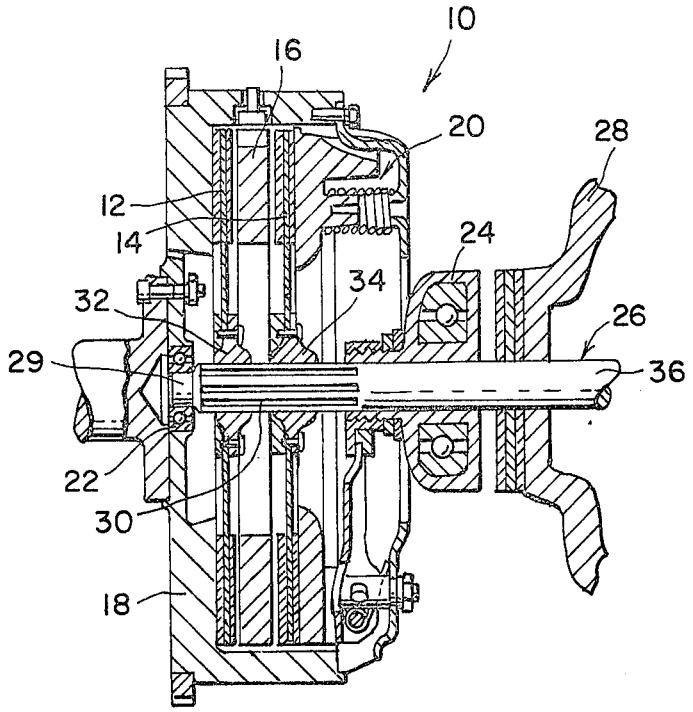
PRIOR ART Fig. 1
FIG. 1 is a longitudinal cross-sectional view of a prior art double disc clutch assembly with associated drive shaft and transmission in place.

In order to fully understand the present invention, the general nature of an automotive clutch, particularly of the double disc type must first be appreciated. A prior art double disc automotive clutch 10 is illustrated in FIG. 1 of the drawing. Clutch 10 comprises a pair of clutch discs 12, 14 with an intermediate pressure plate 16 sandwiched between the discs. The combination of discs 12, 14 and intermediate pressure plate 16 is located between the automotive flywheel 18 and a pressure plate assembly 20. Flywheel 18 has a central pilot bearing 22 and the pressure plate assembly carries a central release bearing 24. A generally cylindrical drive shaft 26, emanating from the automotive transmission 28, is normally located engaged in the clutch assembly 10. Drive shaft 26 includes a neck portion 29 at its front end of reduced diameter which is fitted into pilot bearing 22, a longitudinally splined portion 30 behind neck portion 29, which is engaged in the internally splined hubs 32, 34 respectively of discs 12, 14 and a smooth cylindrical portion 36 which is fitted into release bearing 24. Portions 30 and 36 are of generally the same outside diameter.

Figure 2:
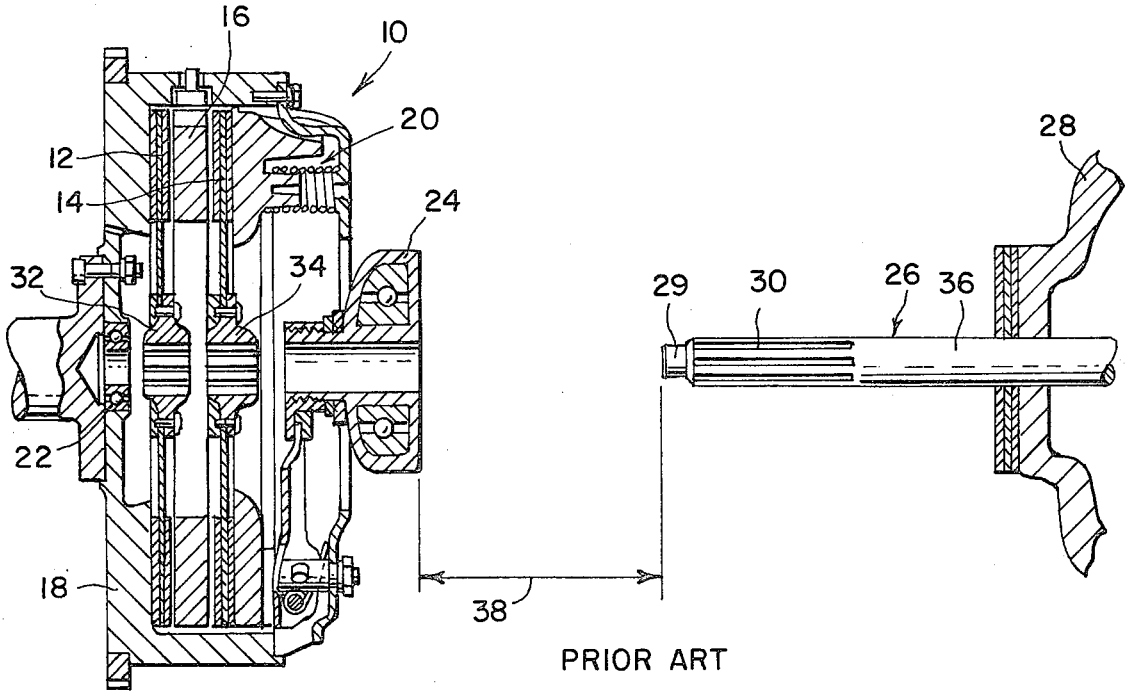
PRIOR ART Fig. 2
FIG. 2 is a longitudinal cross-sectional view similar to FIG. 1, but with the drive shaft and transmission moved axially away from the clutch to enable servicing of the clutch.

When it is necessary to access the interior of clutch 10, for example to replace discs 12, 14 and intermediate pressure plate 16, the transmission 28 must be moved axially away from clutch 10, as shown in FIG. 2, which action withdraws drive shaft 26 from clutch 10. The distance which the transmission 28 and drive shaft 30 combination must be moved away from clutch 10 is determined by the amount of clearance 38 between the back of clutch 10 and the front of drive shaft 26 necessary in order to allow the eventual insertion of an alignment tool into clutch 10 for coaxially aligning the clutch discs 12, 14 with the pilot bearing 22 and release bearing 24 and for also angularly aligning the internal splines of disc hubs 32, 34 just prior to the reinsertion of drive shaft 26 into clutch 10. The greater the required clearance 38, the more accessories and supports (not shown) surrounding transmission 28 have to be moved or removed.

Figure 3:
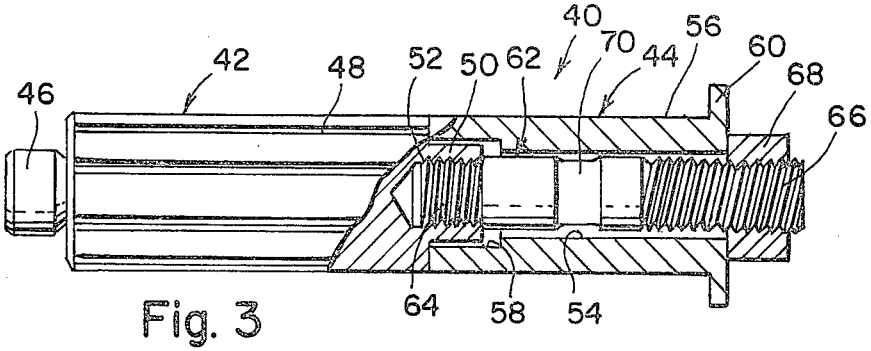
FIG. 3 is a longitudinal view of the tool of the present invention, partly in cross-section, showing the tool with its parts assembled together.

The clutch alignment tool 40 of the present invention, is illustrated in FIG. 3 and includes front and rear axially separable, preferably steel, generally cylindrical members 42 and 44 of generally equal overall length. As the discussion proceeds, it will become apparent that the clearance 38 is only slightly larger than the longer of members 42, 44 because of the ability to axially separate the members.

Front cylindrical member 42, includes a front reduced diameter neck portion 46, virtually identical to drive shaft neck portion 29, a splined surface portion 48 having the same surface configuration as the splined portion 30 of drive shaft 26 except that the splined surface extends to the rear of member 42. Member 42 also has a rearwardly directed neck 50 of reduced diameter, which has an internally threaded axial bore 52.

Rear member 44 is generally tubular and has an inside diameter 54 and an outside diameter 56 of the same dimension as the smooth portion 36 of drive shaft 26. Rear member 44 further has an axial counterbore 58 at its front sized to tightly but slideably receive the rearward directed neck portion 50 of front member 42 in order to maintain members 42 and 44 in coaxial alignment. The combination of neck 50 and counterbore 58 may be thought of as axially mating means carried by members 42 and 44. Additionally, member 44 has a radially extending shoulder 60 at its rear end which is useful for enabling the prying out of tool 40 from clutch 10 as will later become apparent.

For selectively axially locking together front and rear members 42, 44, an elongated preferably steel rod 62 is provided which is sized to pass through the inside diameter 54 of rear member 44. Rod 62 has a threaded front end 64 which is engageable into the internally threaded bore 52 of front member 42 and a threaded rear end 66 which receives a nut 68 that may be tightened against the rear end of rear member 44. Preferably a pair of opposed undercuts 70 in rod 62 are formed (also shown in FIG. 4) at a location intermediate the length of the rod to provide flats for the application of a wrench to tighten the rod into front member 42.

Figure 4:
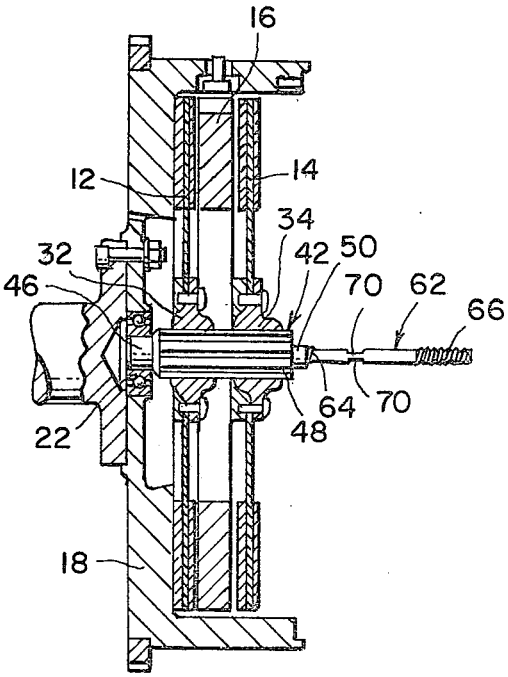
FIG. 4 is a longitudinal cross-sectional view of the clutch of FIG. 2, after the removal of a pressure plate assembly and with a portion of the tool of FIG. 3, inserted therein for alignment of the discs.
Figure 5:
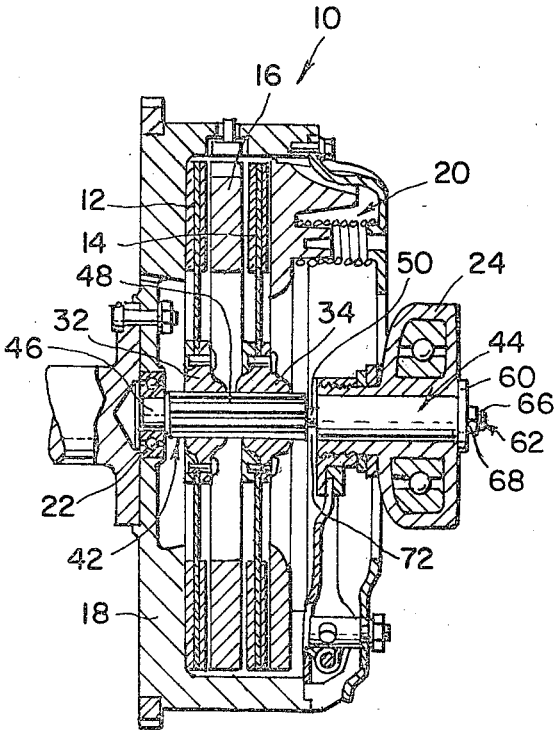
FIG. 5 is a longitudinal cross-sectional view of the clutch of FIG. 4 after replacement of the pressure plate assembly and with the entire tool of FIG. 3 located therein to complete the alignment of the clutch.

The use of tool 40 will best be understood with reference also to FIGS. 4 and 5 of the drawing in addition to FIG. 2. The discs 12, 14 and intermediate pressure plate 16 are accessed for removal and replacement by unbolting the pressure plate assembly from flywheel 18. After the discs and intermediate pressure plate are removed, the front member 42 of tool 40 is then inserted into the balance of clutch 10 with its neck portion 46 in pilot bearing 22. Thereafter the replacement discs 12, 14 with intermediate pressure plate 16 therebetween are slipped over the rear of front member 42 and slid forward into place. It should be appreciated that by slipping the discs onto the member 42 the internal splines of the discs are automatically aligned. Thereafter, the rod 62 is tightened into member 42 utilizing a wrench engaging undercuts 70.

The next operation is to loosely bolt the pressure plate assembly 20 in place. Next, the rear member 44 is placed into clutch 10 so that the neck 50 of front member 42 seats in counterbore 58 of rear member 44, after which nut 68 is engaged on the rear end of rod 62 and loosely tightened to axially lock together members 42 and 44. Then the bolts of pressure plate assembly 20 are tightened to seat the assembly in proper alignment.

The lengths of members 42, 44 are such that with neck 50 and counterbore 58 in sufficient engagement for alignment purposes, and with shoulder 60 against the rear of release bearing 24 and with neck 46 fully seating in pilot bearing 22, there still remains a small space 72 between the outside diameters of members 42 and 44. The purpose of sizing tool 40 to provide the space 72, is that by further tightening of 68, member 42 will be drawn toward member 44 at least partially freeing neck 46 from pilot bearing 22.

The tool 40 is then removed by inserting a prying instrument between shoulder 60 and release bearing 24. After member 44 is part way out of clutch 10 and the entire tool appears to be sliding freely, nut 68 and then member 44 are removed from rod 62 within clearance space 38. Rod 62 is then utilized to further pull member 42 so that its rear is just exposed at the rear of release bearing 24 and its front is just barely engaged in the hub 34 of rearward disc 14. The rod 62 is then untightened from member 42 and also removed within clearance space 38. Thereafter, member 42 is removed within clearance space 38 and the drive shaft 26 may be reinserted in place.

It should now be understood that the tool 40, being composed of axially separable parts and including means controllable at the rear of the tool for selectively axially locking together or unlocking the parts provides a substantial reduction in the required clearance between the clutch and the transmission-drive shaft combination. While the preferred embodiments of the present invention have been described in specific detail, numerous modifications, additions and omissions in the details thereof are possible within the intended spirit and scope of the invention.

What is claimed is:

1. An alignment tool apparatus in the nature of a dummy drive shaft for coaxially aligning the parts of an automotive clutch, said parts including an internally splined clutch disc normally located between an automotive flywheel having a central pilot bearing and a pressure plate assembly having a central release bearing, said tool comprising:

a first elongated generally cylindrical member having a splined surface for engaging said clutch disc, said first cylindrical member having a neck at its front end for engaging said pilot bearing;

a second elongated generally cylindrical member for engaging said release bearing, said second cylindrical member having a front end adapted to be placed against the rear end of said first cylindrical member; and means, controllable from the rear of said second cylindrical member, for selectively axially locking together said first and second cylindrical members with the front end of said first member against the rear end of said second member or unlocking said first and second cylindrical members to enable separation of said members;

said tool apparatus, when said first and second cylindrical members are axially locked together, having an overall length being substantially the sum of the lengths of said first and second members;

whereby said first and second cylindrical members may be selectively assembled together or disassembled from each other while said first cylindrical member is located within said automotive clutch.

2. The apparatus of claim 1, wherein said second cylindrical member is a generally tubular member said first cylindrical member has an internally threaded axial bore at its rear end and said axially locking means includes an elongated rod sized to be inserted through the center of said tubular member and having a threaded front end for engagement in said internally threaded axial bore, and means for simultaneously engaging said rod and said tubular member.

3. The apparatus of claim 1 wherein the splined surface of said first cylindrical member extends to the rear end of said first cylindrical member to permit said clutch disc to be inserted over said first cylindrical member from the rear end of said first cylindrical member.

4. The apparatus of claim 2 wherein the splined surface of said first cylindrical member extends to the rear end of said first cylindrical member to permit said clutch disc to be inserted over said first cylindrical member from the rear end of said first cylindrical member.

5. The apparatus of claim 1 wherein said second cylindrical member includes a radially extending shoulder at its rear end to enable prying of said tool from clutch.

6. The apparatus of claim 2 wherein said second cylindrical member includes a radially extending shoulder at its rear end to enable prying of said tool from clutch.

7. The apparatus of claim 3 wherein said second cylindrical member includes a radially extending shoulder at its rear end to enable prying of said tool from clutch.

8. The apparatus of claim 3 wherein said first cylindrical member is of sufficient length to simultaneously engage two internally splined disc clutches.

9. The apparatus of claim 4 wherein said first cylindrical member is of sufficient length to simultaneously engage two internally splined disc clutches.

10. The apparatus of claim 1 further comprising axially mating means carried by the rear of said first cylindrical member and the front of said second cylindrical member for maintaining said first and second cylindrical members in coaxial alignment.

11. The apparatus of claim 2 further comprising axially mating means carried by the rear of said first cylindrical member and the front of said second cylindrical member for maintaining said first and second cylindrical members in coaxial alignment.

12. The apparatus of claim 3 further comprising axially mating means carried by the rear of said first cylindrical member and the front of said second cylindrical member for maintaining said first and second cylindrical members in coaxial alignment.

* * * * *